United States Patent [19]

Draper et al.

[11] 4,305,119

[45] Dec. 8, 1981

[54] VEHICLE HEADLAMP

[75] Inventors: Geoffrey R. Draper, Lichfield; David A. Birt, Cannock, both of England

[73] Assignee: Lucas Industries Limited, Birmingham, England

[21] Appl. No.: 92,233

[22] Filed: Nov. 7, 1979

Related U.S. Application Data

[63] Continuation-in-part of Ser. No. 39,008, May 14, 1979, Pat. No. 4,246,631.

[30] Foreign Application Priority Data

May 23, 1978 [GB] United Kingdom ..... 21587/78

[51] Int. Cl.[3] ..... F21V 7/00

[52] U.S. Cl. ..... 362/309; 362/327; 362/332; 362/335

[58] Field of Search ..... 362/335, 309, 332, 327

[56] References Cited

U.S. PATENT DOCUMENTS 3,620,600 11/1971 Corbin ..... 362/335

*Primary Examiner*—Stephen J. Lechert, Jr.
*Attorney, Agent, or Firm*—Ladas & Parry

[57] ABSTRACT

A vehicle headlamp has a reflector provided with a reflective area lying on a surface defined by rotating an ellipse about an axis which passes through the inner focus of the ellipse and which is inclined an acute angle (1°–2°) to the focal axis of the ellipse. A shielded filament for producing an inclined cut-off line to the beam is used and is orientated in the opposite sense to that in which it is orientated in a conventional headlamp for producing an inclined cut-off. To produce a Z-beam pattern, lensing at the front of the reflector splits the area of the basic beam pattern immediately below a horizontal portion of the cut-off line into parts which define upper and lower, mutually laterally displaced horizontal cut-off portions in the required Z-beam pattern. The lensing also utilizes a part-circular cut-off portion of the basic beam produced by the reflector and bulb to define an inclined portion of the Z-beam and depress and/or shifts other portions of the basic beam to reinforce other portions of the Z-beam. For U.S. lighting regulations, lensing at the front of the reflector has a first region which raises a portion of the beam defining the substantially horizontal portion of the opposite side, inclined cut-off; a second region which laterally shifts larger, substantially horizontal images spaced below the inclined portion of the opposite side-inclined cut-off so as to augment the images raised by the first region; a third region which deviates downwardly and laterally shifts those larger inclined images which are disposed above said larger substantially horizontal images to further augment the images raised by the first region; and a fourth region which spreads smaller images disposed outwardly of said horizontal and inclined larger images and also compresses in height the portion of the basic beam pattern made up of these smaller images.

1 Claim, 13 Drawing Figures

FIG.1.
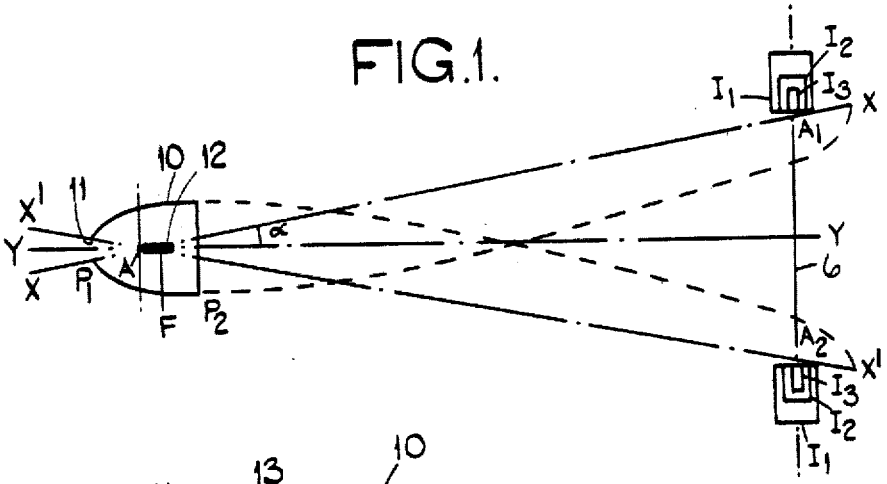
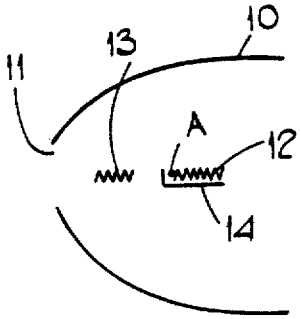
FIG.2.
FIG.3.
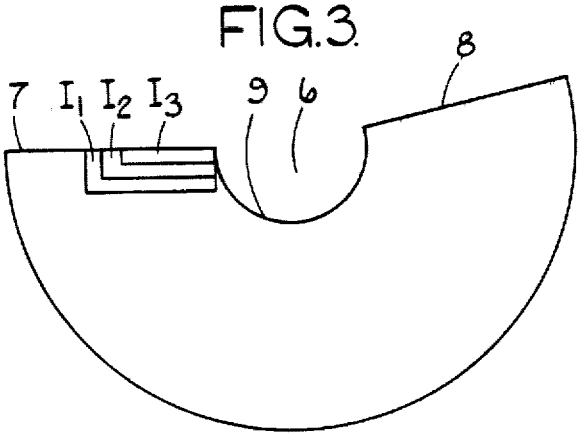

VEHICLE HEADLAMP

This is a continuation-in-part application of U.S. application Ser. No. 039,008 filed May 14, 1979 now Pat. No. 4,246,631.

This invention relates to a vehicle headlamp and is more particularly concerned with a vehicle headlamp which is aimed at attaining the conditions for a passing beam pattern specified in E.C.E. Regulations 8, 20, and 31 or U.S. legislation (SAE J579C). Hereinafter, the former type of passing beam pattern will be referred to as a Z-beam pattern because it basically consists of a beam having its top defined by a light cut-off line having an upper horizontal portion, a lower horizontal portion displaced laterally from the upper horizontal portion, and an inclined portion joining the upper and lower horizontal portions. The above E.C.E. Regulations specify a certain light intensity ratio between a point (HV in the relevant E.C.E. Regulations) above the cut-off line and a point (75L in the relevant E.C.E. Regulations) below the cut-off line. The Z-beam pattern has been specified as a preferred beam pattern in the E.C.E. Regulations in order to reduce dazzle and increase the passing beam range compared with the conventional European passing beam pattern whose upper cut-off line is constituted by a substantially horizontal portion and an inclined portion extending upwardly from one end of the substantially horizontal portion. In this conventional European passing beam pattern (hereinafter referred to as a passing beam having an inclined cut-off), there is also specified a certain light intensity ratio between points (HV and 75L, respectively) above and below the cut-off line.

With a conventional vehicle headlamp, the passing beam pattern having an inclined cut-off can be attained by providing a paraboloidal reflector in which is mounted a passing beam filament and light shield arrangement which produces a basic (i.e. unlensed) beam pattern having a cut-off line consisting of a substantially horizontal portion, an upwardly inclined portion, and a part-circular portion which connects the inclined and substantially horizontal portions. Lensing on the headlamp then modifies this basic beam pattern to produce the required passing beam pattern having an inclined cut-off by shifting portions of the beam inwardly to "fill in" the part-circular cut-off line between the inclined and substantially horizontal portions. A suitable passing beam filament and shield for producing the basic beam pattern with a paraboloidal reflector is provided in a quartz halogen bulb designated as an H4 bulb. These bulbs are widely available commercially. The beam pattern having an inclined cut-off must, of course, be orientated in the correct sense having regard to the rule of the road in the country for which the vehicle headlamp is intended. Thus, in the case where the vehicle headlamp is intended for use on British roads, the beam pattern is orientated so that the substantially horizontal portion is disposed on the right-hand side of the upwardly inclined portion when viewing the beam from behind the headlamp. In the case of countries, such as France, where the vehicles are driven on the right-hand side of the road, the horizontal portion of the cut-off line will be disposed on the left-hand side of the upwardly inclined portion when the beam is viewed from behind the headlamp.

The Z-beam pattern is specified, as mentioned hereinabove, in order to reduce dazzle to road users travelling in the opposite direction and to increase the range of the passing beam compared with the conventional European passing beam having an inclined cut-off.

The problem with such a Z-beam pattern is that it is not possible to produce the required shape to the cut-off as well as the required HV/E75L ratio by the use of lensing when starting with a conventional paraboloidal reflector with a conventional type of bulb, such as a quartz halogen H4 bulb. In view of the very wide availability of H4 bulbs and in view of the fact that the conventional European passing beam having an inclined cut-off is not superseded, but merely supplemented, by the Z-beam pattern specification, it is envisaged that bulbs, such as the H4 bulb, will be widely available for some period of time. Accordingly, the Applicants have conducted extensive investigations into the problem of obtaining a Z-beam pattern from a vehicle headlamp using a conventional bulb having a shielded passing beam filament which is mass produced for use in headlamps projecting the conventional European passing beam having an inclined cut-off.

According to one aspect of the present invention, there is provided a vehicle headlamp comprising a dished reflector which receives, in use, a passing beam filament and shield arrangement producing, with the reflector, a basic beam pattern having an opposite side, inclined cut-off (as defined herein) in use, said dished reflector having a reflective area lying on a surface defined by rotating an ellipse about an axis which passes through the inner focus of the ellipse and which is inclined at an acute angle to the focal axis of the ellipse, and lensing arranged to diffract the basic beam pattern in use, said lensing being arranged (a) to split the area of basic beam pattern immediately below the substantially horizontal portion of the cut-off line into parts which define the upper and lower, mutually laterally displaced horizontal cut-off portions in the required Z-beam pattern (b) to utilise part of the part-circular portion of the cut-off to the basic beam pattern to define the inclined portion joining the upper and lower portions in the required Z-beam pattern, (c) to depress an area of the basic beam pattern below the inclined portion of the cut-off thereof and (d) to shift laterally part of the basic beam pattern below the inclined portion of the cut-off thereof so as to increase the intensity of that portion of the Z-beam pattern which is below the junction between the upper horizontal cut-off portion and the inclined portion.

By the term "basic beam pattern" as used herein is meant the unlensed beam pattern produced by the combination of reflector and passing beam filament and shield arrangement. By the expression "opposite side, inclined cut-off" as used herein is meant a cut-off line to the top of the basic beam which comprises a substantially horizontal portion, an upwardly inclined portion spaced to one side of the substantially horizontal portion and a part-circular portion joining the two aforesaid portions, with the inclined and horizontal portions being so mutually arranged as to correspond with their arrangement in the basic beam pattern required for driving on the opposite side of the road to that for which the vehicle headlamp is intended.

Thus, in accordance with the present invention, the use of a paraboloidal reflector is avoided; a conventional type of bulb can be used, but is orientated within the reflector in the opposite sense to that which is normal having regard to the side of the road on which a motor vehicle fitted with the headlamp is to be driven;

and the lensing arrangement is totally different from a conventional lensing arrangement for producing a conventional E.C.E. passing beam pattern with an inclined cut-off. The lensing in a vehicle headlamp according to the present invention diffracts the more important portions of the basic beam pattern in a manner which is totally contrary to the normal practice of lensing of a basic beam pattern.

The use of a dished reflector having the shape defined hereinabove, rather than a paraboloidal shape means that a more advantageous light intensity of the images in the basic beam pattern is obtained for producing the required Z-beam pattern, as will be apparent hereinafter.

Preferably, said part of the basic beam pattern which is laterally shifted to increase the intensity of said portion of the Z-beam pattern below the junction between the upper horizontal cut-off portion and inclined cut-off portion is one in which the filament images are horizontally disposed. This portion of increased intensity includes the point 75L specified in E.C.E. Regulations.

In a preferred embodiment, the lensing comprises (i) a first lensing portion which is arranged to receive light from a peripheral reflector part which produces filament images forming part of the basic beam immediately below the substantially horizontal portion of the cut-off line, said first lensing portion being arranged to lift and shift inwardly the light passing therethrough; and (ii) a second lensing portion which is disposed inwardly of the first lensing portion so as to receive images from a part of the reflector disposed inwardly of said peripheral reflector part, said second lensing portion being arranged to depress and shift light passing therethrough through the axis of the reflector, the inclined portion of the required Z-beam pattern being defined by the inner end of filament images passing through the first lensing portion.

Preferably also, the lensing further includes a third lensing portion which is arranged to receive light from a peripheral part of the reflector on the opposite side thereof to the first-mentioned peripheral reflector part, said third lensing portion being arranged to effect step (d) hereinabove whereby only the smaller filament images are shifted to below said junction between the upper, horizontal cut-off portion and the inclined cut-off portion in the required Z-beam pattern; and a fourth lensing portion disposed inwardly of the third lensing portion and arranged to depress and spread of larger images constituting part of the basic beam defining the inclined cut-off.

It will be well appreciated by a person skilled in the art, the form the various portions of the lensing should take in order to produce the specified effects, once these effects are realised.

In the above mentioned first aspect of the invention, the vehicle headlamp design is such as to enable the production of the Z-beam pattern. However, similar basic principles can be applied to a vehicle headlamp design for attaining the condition specified for a passing or dipped beam pattern under the latest U.S. legislation (SAE J579C). Whilst European legislation (E.C.E. regulation) requires a sharp cut-off to the top of the beam and a good glare control to the offside of the road, the U.S. legislation places a particular emphasis upon illumination along and across the nearside carriageway and the verge and also restricts light to the offside to avoid dazzle to the oncoming driver.

Thus, for U.S. legislation requirements there is provided a vehicle headlamp comprising a dished reflector which receives, in use, a passing beam filament and shield arrangement producing, with the reflector, a basic beam pattern having an opposite side, inclined cut-off (as defined herein) in use, said dished reflector having a reflective area lying on a surface defined by rotating an ellipse about an axis which passes through the inner focus of the ellipse and which is inclined at an acute angle to the focal axis of the ellipse, and lensing arranged to diffract the basic beam pattern in use, said lensing having a first region which raises a portion of the beam defining the substantially horizontal portion of the opposite side, inclined cut-off, a second region which laterally shifts larger, substantially horizontal images spaced below the inclined portion of the opposite side-inclined cut-off so as to augment the images raised by the first region; a third region which deviates downwardly and laterally shifts those larger inclined images which are disposed above said larger substantially horizontal images to further augment the images raised by the first region; and a fourth region which spreads smaller images disposed outwardly of said horizontal and inclined larger images and also compresses in height the portion of the basic beam pattern made up of these smaller images.

An embodiment of the present invention will now be described, by way of example, with reference to the accompanying drawings in which:

FIG. 1 is a schematic illustration of a lamp reflector forming part of a vehicle headlamp according to the present invention, showing the packing of images obtained by the reflector from a shielded passing beam filament;

FIG. 2 is a schematic illustration of the reflector illustrated in FIG. 1 showing the relative positions in the reflector of the shielded passing beam filament and a main beam filament;

FIG. 3 is a schematic illustration of the basic beam pattern produced by the reflector of FIGS. 1 and 2 being the shielded passing beam filament;

Figure 4:
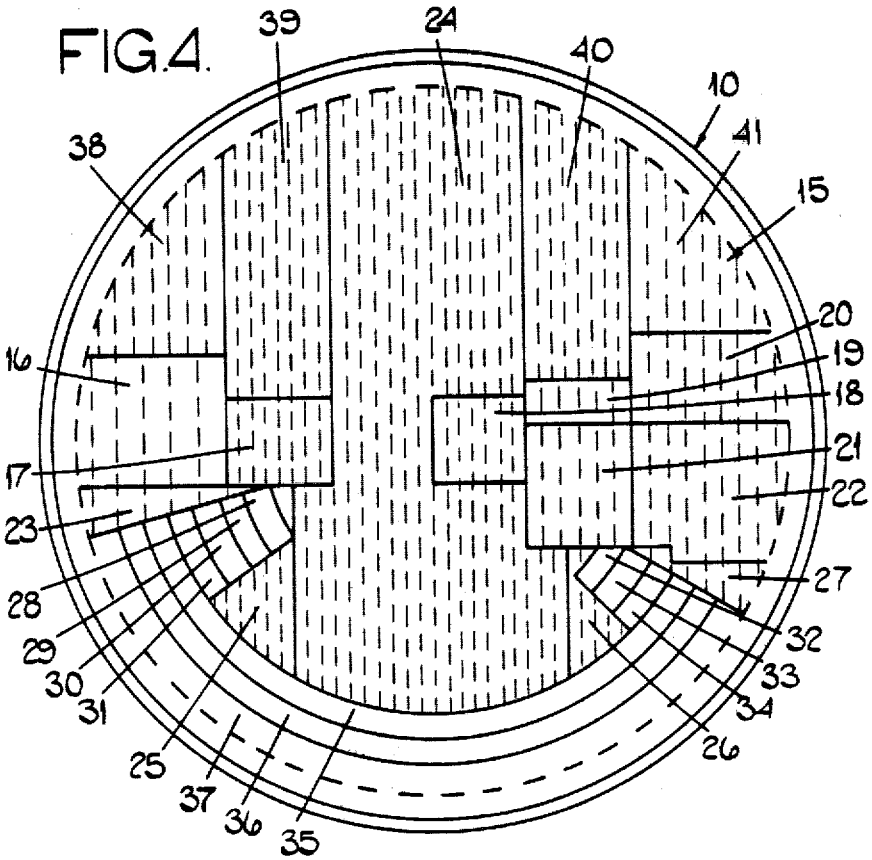
FIG. 4 is a front view of a vehicle headlamp according to the present invention incorporating the lamp reflector of FIGS. 1 and 2 and including the lensing for modifying the basic beam pattern produced by the reflector.

Referring now to FIGS. 1 and 2 of the drawings, the lamp reflector 10 illustrated therein is dished and has an internal reflective surface defined by rotating part of an ellipse about an axis Y—Y which passes through the inner focus A of the ellipse and which is inclined at an angle $\alpha$ (in this embodiment, 1 degree) with respect to the major axis of the ellipse. Rotation of the ellipse in this manner produces an infinite number of outer foci $A_1$, $A_2$ lying in a ring. Thus, the reflector 10 is made up of an infinite number of ellipses disposed around the axis Y—Y with their major axes each disposed at the angle $\alpha$ to the axis Y—Y and each having its inner focus coincident with A. In FIG. 1, a horizontal section of the reflector 10 is illustrated, the reflector surface extending on each side of the axis Y—Y from point $P_1$ and $P_2$. A hole 11 is provided at the rear of the reflector 10 for receiving a bulb (not shown). In this embodiment, the bulb is a completely conventional quartz halogen bulb known as an H4 bulb. The quartz halogen bulb is provided with a passing beam filament 12 (FIGS. 1 and 2) and a main beam filament 13 (only shown in FIG. 2). The passing beam filament 12 is disposed with its inner end coincident with A. The passing beam filament 12 is provided with a shield 14 thereunder whose shape is known per se. The shield 14 is provided as part of the H4 bulb. The front end of the main beam filament 13 is spaced behind the inner focus A. The filaments 12 and 13 lie on the axis Y—Y. An opening at the front (i.e. the end of the reflector remote from the hole 11) of the reflector 10 is closed by a lens element 15 (not shown in FIGS. 1 and 2 but shown in FIG. 4). On the right-hand side of FIG. 1 there is shown the image packing obtained by the reflector 10 at a plane which lies at the outer foci $A_1$, $A_2$ . . . etc. $A_1$ and $A_2$ are spaced apart horizontally on opposite sides of the axis Y—Y by a distance which depends upon the angle and the focal length of the ellipses. The ellipses shown in FIG. 1 have respective focal axes X—X and X'—X'.

With the above described construction of reflector 10 and arrangement of passing beam filament 12, a basic passing beam is produced in which images $I_1$, $I_2$ and $I_3$ from each elliptical portion of the reflector 10 have ends corresponding to the inner end of the filament 12 coincident with the respective outer focus $A_1$, $A_2$ etc. Thus, without any lensing or shielding, a toroidal beam pattern is projected by the reflector 10 in which the maximum light intensity is at the inner periphery thereof around a hole 6. There is a sharp cut-off of light around the hole 6. The provision of the shield 14 enables a basic beam pattern of the type illustrated in FIG. 3 to be produced where, in accordance with conventional practice, the shield 14 produces a cut-off to the top of the beam. The cut-off is comprised by a line consisting of a substantially horizontal linear portion 7, an upwardly inclined linear portion 8 disposed at an angle of 15 degrees to the horizontal and a part-circular portion 9 which joins the portions 7 and 8 and which bounds part of the hole 6. The shape of this basic beam pattern is virtually identical to that obtained by a conventional arrangement of paraboloidal reflector and H4 bulb except, of course, that the arrangement of the images $I_1$, $I_2$ and $I_3$ within the basic beam pattern is different in that their inner ends are coincident upon the part-circular portion 9 of the cut-off line. It is to be appreciated that, in a conventional paraboloidal reflector, a beam pattern is obtained in which the images do not have their inner ends coincident with the part-circular portion 9 of the cut-off line. The manner in which the basic beam pattern illustrated in FIG. 3 is modified to produce a Z-beam pattern (FIG. 5) will now be described with reference to FIGS. 4 to 9.

Figure 7:
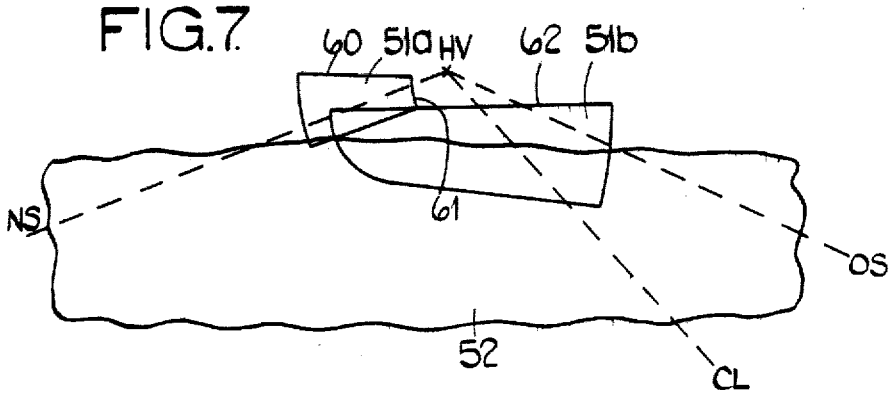
FIG. 7 is a schematic illustration showing how two parts of the basic beam pattern are shifted to produce the required cut-off line.

Referring first to FIG. 4, the lens element 15 has various lens portions 16 to 41. The basic beam pattern projected by the unlensed reflector 10 from the passing beam filament 12 is shown notionally split into three basic parts 51, 52 and 53, of which part 51 is sub-divided into parts 51*a* and 51*b*, and superimposed upon a schematic representation of a road where the line NS corresponds to the nearside curb of the road, the line OS corresponds to the offside curb of the road and the line CL corresponds to the centre of the road. O represents the optical axis of the reflector and corresponds to the axis Y—Y illustrated in FIG. 1. HV corresponds to a specified low intensity standard beam photometry point in the appropriate E.C.E. Regulations. The portion 51*a* of the part 51 is a portion which contains the smaller filament images $I_3$ whereas the portion 51*b* contains the larger filament images $I_1$ and is produced by a portion of the reflector 10 which is disposed inwardly of a peripheral portion which produces the smaller images in portion 51*a*. In use, the filament images in the portion 51*a* passes through the lens portion 16. The lensing in the portion 16 is arranged to displace the images passing therethrough ½ degree to the right and ½ degree up from the position illustrated in FIG. 6. The resultant position of the portion 51*a* is illustrated in FIG. 7. Light from the portion 51*b* passes through the lens portion 17 which has lensing therein arranged to displace the portion 51*b* 5 degrees to the right and also to spread the image horizontally.

After lensing, the upper edge of the portion 51*a* defines the desired upper horizontal portion of the cut-off to the final Z-beam pattern. This upper horizontal portion is identified by reference numeral 60 in FIG. 7. After lensing, the inner end of the portion 51*a* (i.e. a part defining part of the part-circular portion 9 of the basic beam pattern) defines the inclined portion of the cut-off to the final Z-beam pattern. This inclined portion is identified by the reference numeral 61 in FIG. 7. The portion 51*b*, after lensing, defines the lower horizontal portion of the final Z-beam pattern. This lower horizontal portion is identified by the reference numeral 62 in FIG. 7. Those portions 60 and 62 very closely correspond to the upper and lower horizontal cut-off lines 63 and 64 of the required Z-beam pattern illustrated in FIG. 5 whilst the portion 61 corresponds to the desired inclined portion 65 shown in FIG. 5.

The portion 52 of the basic beam pattern emanates from the upper portion of the reflector and passes through the lens portions 24, 38, 39, 40 and 41. Basically, the lens portions 24, 38, 39, 40 and 41 provide a wide spread to the portion 52 of the basic beam pattern to produce the spread outline 52 illustrated in FIG. 7. As can be seen in FIG. 7, this portion 52 is disposed below the lower horizontal cut-off portion 62.

Figure 8:
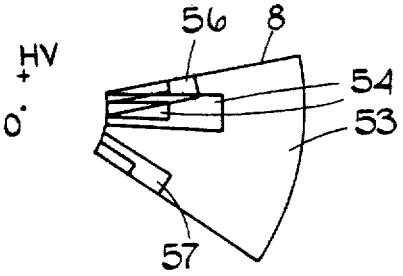
FIG. 8 is a schematic illustration showing the image distribution in a further part of the basic beam pattern illustrated in FIG. 6.
Figure 9:
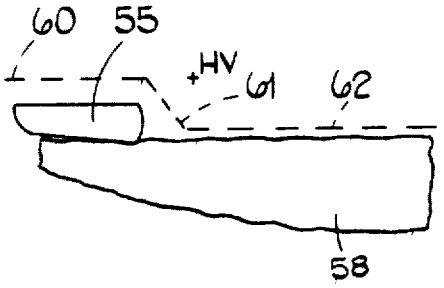
FIG. 9 is a schematic illustration showing the images illustrated in FIG. 8 after lensing.

The manner in which the images in portion 53 of the basic beam pattern are dealt with is illustrated in FIGS. 8 and 9. Images 54 in the portion 53 which are horizontally disposed are lensed 4 degrees to the left and ¼ degree down by passing through the lens portion 20. It will be appreciated that the lens portion 20 diffracts only the relatively small images emanating from the periphery of the reflector 10 on the opposite side thereof to the images which define the portion 51*a* of the basic beam pattern. The images 54 in being so diffracted by the lens portion 20 appear in the final beam pattern in area 55 (see FIG. 9). Area 55, as will be seen includes the standard beam photometric point designated as 75L in FIG. 5. The larger horizontally disposed images in the beam portion 53 pass through the lens portion 19 to be diffracted ½ degree down and spread both horizontally and vertically. Images 56 in the beam portion 53 are upwardly inclined and disposed immediately below the inclined portion 8 of the cut-off line to the basic beam pattern. The smaller images 56 pass through the lens portion 22 whilst the larger images 56 pass through the lens portion 21. The lens portion 21 is formed so as to produce image inverting and horizontal and vertical spreading. To effect image inverting, it lenses ½ degree down at the top and 1½ degrees down at the bottom. The lens portion 22 is similarly formed except that it lenses ¼ degree down at the top and 1 degree down at the bottom. Images 57 in the beam portion 53 are downwardly inclined and are spread both vertically and horizontally by the lens portions 40 and 41. The net result of the diffraction of the images 56 and 57 is to produce a broad spread of light in area 58 illustrated in FIG. 9. Ideally, the upper edges of areas 55 and 58 coincide respectively with the upper horizontal portion 60 and the lower horizontal portion 60 and the lower horizontal portion 62. However, due to permitted tolerances in the H4 bulb, the upper edges of the areas 55 and 58 are disposed below the lines 60 and 62 respectively in order to prevent breakthrough of images above the lines 60 and 62. The remaining parts of the lens element 15 constituted by lens portion 23, the lower portion of lens portion 24, and the lens portions 25 to 37 will not be described in any further detail except to state that the lens portions 23 and 27 are merely for styling purposes and the lens portions 24, 25, 26 and 28 to 37 are provided for use only under main beam conditions. Under main beam conditions, light emanates from the filament 13 rather than the filament 12 and this is relatively unshielded so that the whole of the reflector is used. In this event, the lens portions 24, 25, 26 and 28 to 37 are used to diffract the beam projected by the headlamp so as to fill in the areas of the required beam which are of insufficient intensity. It will be appreciated that, as in all cases where a headlamp is intended for use under dipped and full beam conditions, the beam pattern under full beam conditions is a compromise having regard to the lensing which is already provided for use under passing beam conditions.

Figure 5:
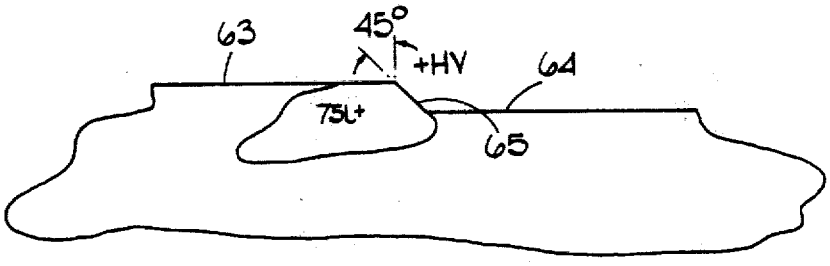
FIG. 5 is a schematic illustration of the most important part of a Z-beam pattern required to be produced.
Figure 6:
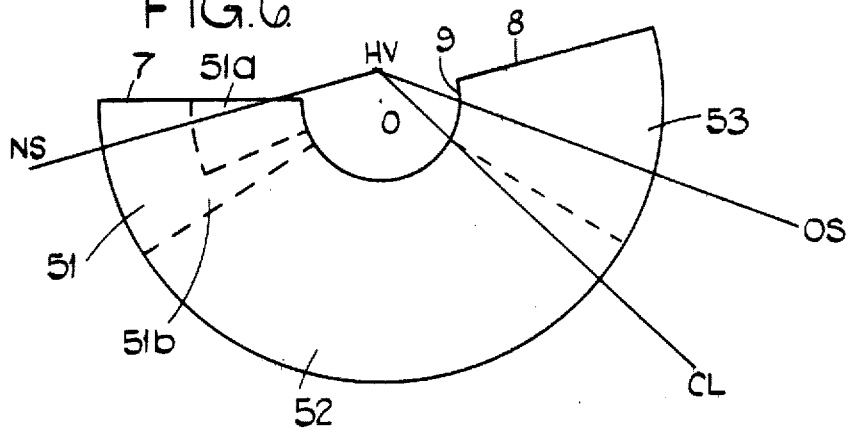
FIG. 6 is a schematic illustration of the basic beam pattern of FIG. 3 showing, in dotted line, the basic manner in which it is notionally divided for lensing.

It will be appreciated from a comparison of FIGS. 3 and 5 that the basic beam pattern produced and illustrated in FIG. 3 is more appropriate, when conventionally lensed, for use in providing a conventional European beam with an inclined cut-off for use in countries where the motor vehicles are driven on the right-hand side of the road. However, as will be appreciated from FIG. 7, the resultant Z-beam pattern produced is intended for use in countries, e.g. in Great Britain, where motor cars are driven on the left-hand side of the road. Although the headlamp described hereinabove with reference to the drawings is one having a circular front opening, it is to be appreciated that, mutatis mutandis, the invention is also applicable to headlamps having a substantially rectangular front opening. In such an event, it is preferred for the angle α to be approximately 1.5 degrees. Of course, the lens element for a reflector having a substantially rectangular front opening will be of rather different shape from the individual portions described with reference to FIG. 4. However, the basic principles in designing the lens element for a rectangular headlamp are the same as those for a circular headlamp in that the various portions of the basic beam pattern projected by the reflector are diffracted in the manner described hereinabove in order to produce the required Z-beam pattern.

α can vary, however, from 1 degree to 2 degrees depending upon the shape and size of reflector chosen. Above about 2 degrees, there is a tendency for the intensity of the images to be lowered whereas below 1 degree gives problems of light scatter above the cut-off. The rear end of the passing beam filament is usually located on the inner focus of the reflector since movement of the filament nearer to the hole 11 at the rear of the reflector causes light scatter above the cut-off but increases the light intensity. On the other hand, movement of the filament further away from the hole 11 at the rear of reflector increases the sharpness of the cut-off but reduces the intensity.

In order to satisfy the E.C.E. regulations, in the previously described embodiment, the portion 51*b* of the basic beam pattern is depressed and shifted to the offside by the lens portion 17 in order to define the lower horizontal portion of the final Z-beam pattern. This portion 51*b* and other adjacent portions cannot be treated in this manner if the relevant SAE regulations are to be met.

Figure 10:
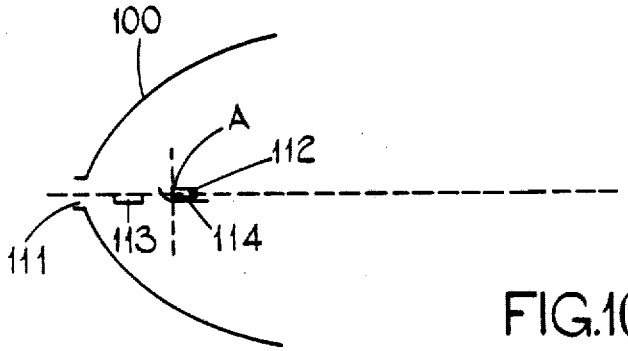
FIG. 10 is a schematic illustration of a lamp reflector forming part of a vehicle headlamp according to the present invention, and showing the axial mounting of lamp filaments therein.

Referring now to FIG. 10, the reflector 100 illustrated therein is the same as described hereinabove with reference to the lamp reflector 10. Briefly, the lamp reflector 100 is dished and has a reflective area lying on a surface defined by rotating an ellipse about an axis which passes through the inner focus A of the ellipse and which is inclined at an acute angle to the focal axis of the ellipse.

Like the embodiment of FIG. 1 described hereinabove, the reflector 100 has a rear aperture 111 which receives a quartz halogen bulb so that a passing beam filament 112 and a main beam filament 113 thereof extend along the focal axis of the reflector 100. The passing beam filament 112 is disposed with its inner end coincident with A. The passing beam filament 112 is provided with a shield 114 thereunder whose shape is known per se and which is provided as part of the bulb. In the present embodiment, the bulb employed is the same as a conventional H4 bulb except that it is rated at 64/54 watts maximum at 12.8 volts as opposed to a conventional H4 bulb which is rated at 60/55 watts at 12 volts. The bulb is orientated in the aperture 111 so that the cut-off produced by the filament 114 is an "opposite side, inclined cut-off" as defined herein. The basic beam pattern produced by the reflector and bulb assembly illustrated in FIG. 10 is shown in full line in FIG. 11. It will be seen that this is the same basic beam pattern as is illustrated in FIG. 3. However, in contrast to the vehicle headlamp of FIGS. 1 to 7, the vehicle headlamp of FIGS. 10–13 is intended for use in a country in which vehicles are driven on the right-hand side of the road.

Figure 11:
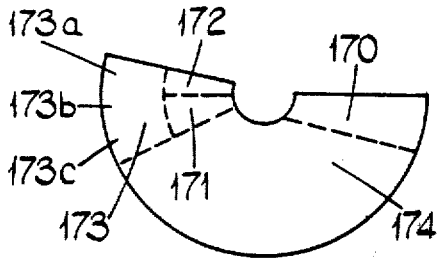
FIG. 11 is a schematic illustration of the basic beam pattern produced by the reflector and shielded filament arrangement of FIG. 1.
Figure 12:
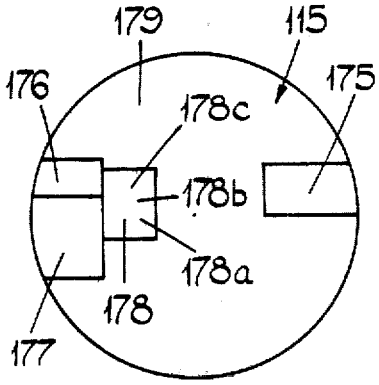
FIG. 12 is a schematic front view of the more important parts of a vehicle headlamp lens intended for use with the reflector of FIG. 1.
Figure 13:
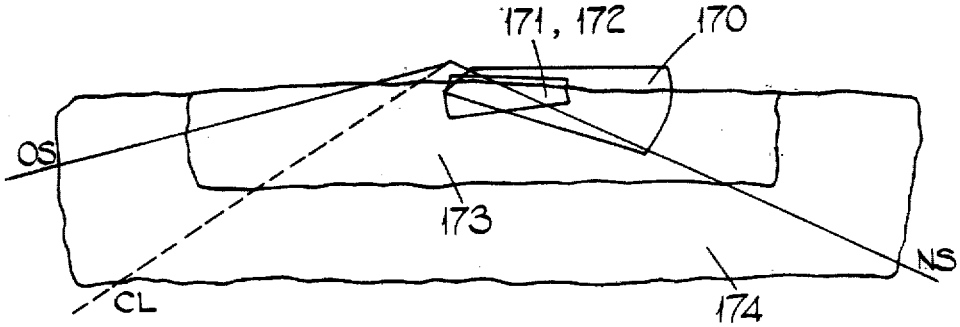
FIG. 13 is a schematic illustration showing how various parts of the basic beam pattern produced by the reflector and filament construction illustrated in FIG. 10 are shifted to produce the required illumination.

In order to diffract the basic beam pattern illustrated in FIG. 11 suitably to enable the SAE J579C specification to be met, a lens element 115 is provided (see FIG. 12). The basic beam pattern illustrated in FIG. 11 is notionally divided into first to fifth portions 170–174, respectively, the first portion 170 consists of small and large filament images which define the horizontal portion to the cut-off of the basic beam pattern. The second portion 171 consists of larger filament images which are substantially horizontally disposed, these images being spaced below the inclined portion of the cut-off to the basic beam pattern. The third portion 172 is disposed above the second portion 171 and consists of the larger images which are inclined and which define part of the inclined portion of the cut-off to the basic beam pattern. The fourth portion 173 consists of smaller images disposed outwardly of the second and third portions 171 and 172. The fourth portion 173 is notionally divided into an upper part **173*a* wherein the images are upwardly inclined, an intermediate part 173*b* wherein the images are substantially horizontal, and a lower part 173*c* wherein the images are downwardly inclined. The fifth portion 174 is defined by the portion of the basic beam pattern between the first portion 170 and the lower edges of the second and fourth portions 171 and 173**.

Referring now to FIG. 12, the lens element 115 includes five sections 175 to 179, respectively. The first section 175 incorporates an upward deviating prism to lift images forming the first portion 170 of the basic beam pattern 0.5 to 0.75 of a degree upwardly so as to produce an area of high intensity in the lensed beam pattern projected by the vehicle headlamp (see FIG. 13 where portions of the projected beam corresponding to the portions of the basic beam pattern illustrated in FIG. 11 are accorded the same reference numeral). The portion 170 of the basic beam pattern has a well defined cut-off at its top and at its left-hand edge. The second section 176 of the lens element 115 incorporates a prism which deviates the images forming the second portion 171 of the basic beam pattern between 4 degrees and 6 degrees to the right so as to reinforce the portion 170 (FIG. 13) of the beam projected by the vehicle headlamp.

The third section 177 of the lens element 115 includes a prism which deviates images forming the third portion 172 of the basic beam pattern of FIG. 11 both downwardly and to the right so as to reinforce further the portion 170 (FIG. 13) of the final beam pattern projected by the headlamp.

The fourth section 178 is notionally divided into parts **178*a*, 178*b* and 178*c* through which the parts 173*a*, 173*b* and 173*c*, respectively pass. The fourth section 178 of the lens element 115 is basically a combination of a flute giving a horizontal spread of approximately 10° and a vertical effect which gives the greatest depression to the top of the portion 173. Thus, light from the basic beam part 173*c* passes through lens part 178*c* and has no vertical deviation whilst progressive downward deviation occurs upon passage of basic beam parts 173*b* and 173*a* through the lens parts 178*b* and 178*a*. The result of this fourth section 178 of the lens element 115 is to compress the overall height of the fourth portion 173 of the basic beam pattern illustrated in FIG. 11 whilst spreading it. The effect of this is shown in the portion referenced 173 in FIG. 13** where it will be seen that it provides the necessary control of illumination at the top of the beam projected by the vehicle headlamp.

The fifth section 179 of the lens element 115 consists of conventional lensing to provide the wider angle illumination of the beam pattern projected. This fifth section 179 deals with the images which form the fifth portion 174 of the basic beam pattern.

The lower portion of the lens element 115 illustrated in FIG. 12 is only intended to be used when the main beam filament 113 is in operation. Here again, the lensing for this is conventional and will not be described herein.

It will be appreciated that the above described vehicle headlamp construction is very different from the type of headlamp construction which has been used in the past for satisfying previous U.S. headlamp beam regulations. In such known lamp constructions, it is common practice to employ a paraboloidal reflector, to arrange for the main and headlamp beam filaments to be disposed transversely of the optical axis of the reflector rather than aligned with the optical axis, and to provide a completely different filament shield and lensing arrangement in view of these differences.

We claim:

1. A vehicle headlamp comprising a dished reflector which receives, in use, a passing beam filament and shield arrangement producing, with the reflector, a basic beam pattern having an opposite side, inclined cut-off (as defined herein) in use, said dished reflector having a reflective area lying on a surface defined by rotating an ellipse about an axis which passes through the inner focus of the ellipse and which is inclined at an acute angle to the focal axis of the ellipse, and lensing arranged to diffract the basic beam pattern in use, said lensing having a first region which raises a portion of the beam defining the substantially horizontal portion of the opposite side, inclined cut-off; a second region which laterally shifts larger, substantially horizontal images spaced below the inclined portion of the opposite side-inclined cut-off so as to augment the images raised by the first region; a third region which deviates downwardly and laterally shifts those larger inclined images which are disposed above said larger substantially horizontal images to further augment the images raised by the first region; and a fourth region which spreads smaller images disposed outwardly of said horizontal and inclined larger images and also compresses in height the portion of the basic beam pattern made up of these smaller images.

* * * * *